United States Patent [19]

Landa

[11] 4,256,820

[45] Mar. 17, 1981

[54] METHOD OF ELECTROPHOTOGRAPHY USING LOW INTENSITY EXPOSIVE

[75] Inventor: Benzion Landa, Edmonton, Canada

[73] Assignee: Savin Corporation, Valhalla, N.Y.

[21] Appl. No.: 97,512

[22] Filed: Nov. 26, 1979

Related U.S. Application Data

[63] Continuation of Ser. No. 908,355, May 22, 1978, abandoned.

[51] Int. Cl.[3] ..... G03G 13/22; G03G 13/04

[52] U.S. Cl. ..... 430/54; 430/31; 430/103; 430/126; 355/3 R

[58] Field of Search ..... 430/31, 54, 103, 126; 355/3 R

[56] References Cited

U.S. PATENT DOCUMENTS

| | | | |
|---|---|---|---|
| 2,756,676 | 7/1956 | Steinhilper | 430/126 |
| 3,251,685 | 5/1966 | Bickmore | 430/103 |
| 3,262,806 | 6/1966 | Gourge | 430/103 |
| 3,322,537 | 5/1967 | Giamo | 430/50 |
| 3,355,288 | 11/1967 | Matkan | 430/31 X |
| 3,945,822 | 3/1976 | Verhille | 430/54 |
| 4,135,927 | 1/1979 | Draugelis et al. | 430/44 |

FOREIGN PATENT DOCUMENTS

| | | | |
|---|---|---|---|
| 2219005 | 12/1972 | Fed. Rep. of Germany | 430/54 |

*Primary Examiner*—Roland E. Martin, Jr.
*Attorney, Agent, or Firm*—Shenier & O'Connor

[57] ABSTRACT

My invention comprises an improved method of electrophotography which enables me to increase the effective speed of a photoconductor. The speed at which copies may be made is a function of the quantum of light falling on the photoconductive surface and the conductivity of the photoconductor under illumination. Since the rate at which a given photoconductor discharges the surface potential on the photoconductor through the action of light is limited, speed can be increased for a given photoconductor only by increasing the illumination. This requires energy and produces heat. My process deliberately underexposes a charged photoconductor to a light and shade image of the original to produce a weak latent electrostatic image of low contrast which is insufficient to make a satisfactory copy. I then mask the latent image with a liquid-carried toner while preventing deposition of the toner on the background areas. I then discharge the background areas with a blanket illumination of low intensity. The optical mask prevents the image areas from discharging while enhancing the constrast of the weak latent image. The enhanced image is then easily developed by any known developing method for making latent electrostatic images visible at a development station.

5 Claims, 5 Drawing Figures

METHOD OF ELECTROPHOTOGRAPHY USING LOW INTENSITY EXPOSIVE

This application is a continuation of application Ser. No. 908,355, filed May 22, 1978, now abandoned.

BACKGROUND OF THE INVENTION

One of the main problems with electrophotographic copiers arises from the desire for speed in copy production. After a photoconductor has been charged, the energy required to produce a latent image in light and shade of the original of sufficient contrast to produce an acceptable copy is a function of the quantum of light falling upon the photoconductor and the light sensitivity of the photoconductor. Ideally, the illumination of the photoconductor should be such that the brightest part of the image will be fully discharged while the darkest part of the image will leave the photoconductor fully charged. In practice, this is never achieved, owing to the limits of the light response of known photoconductors. In the current state of the art of photocopying machines, when the speed of producing copies exceeds about 30 copies per minute, the energy required to operate the copier approaches 1500 watts. Since the ordinary potential in office and house wiring is 110 volts, the power from a given outlet is limited to 1500 watts. Accordingly, to produce satisfactory copies at a higher rate, a special electrical installation will be required. This means that the copying machine cannot be decentralized, but must be located in the region of the higher voltage outlet. Furthermore, the high energy will produce thermal problems, both in respect of the photoconductor and in the environment, aside from the expense of energy consumption. Because of these problems, many efforts are being made to increase the light sensitivity of photoconductors.

1. Field of the Invention

My invention relates to a novel method of increasing the effective sensitivity of photoconductors, thus enabling me to increase the speed of electrophotographic reproduction of documents.

2. Description of the Prior Art

The following art is of interest in respect of or is referred to in this specification:

Steinhilper—U.S. Pat. No. 2,756,676
Schaefer et al—U.S. Pat. No. 3,892,481
Hayashi et al—U.S. Pat. No. 3,907,423
Brooke—U.S. Pat. No. 3,912,387
Brooke—U.S. Pat. No. 3,994,723

Steinhilper, which will be discussed more fully hereinafter, proposes to make multiple copies of an image produced from a single light exposure of an original. He recharges the photoconductor after each transfer of a developed image and enhances the recharged image by subjecting it to illumination. There is no teaching of increasing the speed of the xerographic reproduction process. The apparatus shown by Steinhilper has only one development station. There is no optical masking station. There is no showing of a biased toner applicator at a toning station where optical shielding is achieved.

Schaefer et al show an automatic control system for biasing a development electrode. This system can be used both for the mask-forming step, which is a salient feature of my invention, and for the development step as taught by Schaefer et al.

Hayashi et al show a reverse roller designed to remove excess liquid from the photoconductor after the latent image has been developed. I employ a roller of this type, insulated from ground and biased to a voltage of the same polarity as the charge on the photoconductor, but at a potential higher than the background potential, in order to ensure that no toner is deposited on the background areas of the image when the mask-forming step is performed.

Brooke U.S. Pat. No. 3,912,387 and its divisional U.S. Pat. No. 3,994,723 show detecting background areas which are underexposed and discharging them by light before development of the latent electrostatic image.

SUMMARY OF THE INVENTION

One object of my invention is to provide an improved method of electrophotography which will increase the speed of the copying operation.

Another object of my invention is to provide an improved method of electrophotography which will increase the speed of copying and reduce the quantum of energy required in the operation.

Another object of my invention is to increase the effective speed of photoconductors.

Another object of my invention is to provide an improved method of electrophotography which will enable me to copy originals having poor contrast.

Another object of my invention is to copy originals of a color to which the photoconductor has a great sensitivity.

Another object of my invention is to provide a novel apparatus for carrying out my improved method of electrophotography.

Other and further objects of my invention will be apparent from the following description.

BRIEF DESCRIPTION OF THE DRAWINGS

In the accompanying drawings, which form part of the instant specification and which are to be read in conjunction therewith.

DESCRIPTION OF THE PREFERRED EMBODIMENT

In general, my invention contemplates charging a photoconductor in the dark. The charged photoconductor is then exposed to a light and shade image of the original. This will form a latent electrostatic image on the photoconductor. The original exposure is only a fraction, such as 5% or 10%, of the quantum of light normally required to produce a satisfactory image— that is, one having sufficient contrast so the image areas are dark and the background areas are white. The latent image thus formed has sufficient contrast, however, so that it can be toned—that is, developed—with any appropriate toner such as resinous powder or, more preferably, by a toner dispersed in an insulating liquid, as is well known to the art. This masking step produces a shield substantially opaque to light over the image areas of the original being copied. A critical feature of the masking step is that a shield will be produced only over the image areas, and not over any of the background areas. This is accomplished by ensuring that the development electrode, or means for applying the toner, during the masking step is biased to a potential above that existing on the background areas and below that present on the image areas of the latent electrostatic image.

I then expose the photoconductor to a blanket of light. The electrostatic charge of the masked image on the photoconductor will decay marginally or not at all, while the electrostatic charge of the background areas will be discharged to a very low voltage, such as 50 volts or the like. This has the effect of enhancing the charge of the latent electrostatic image by a very large percentage with the requirement of about one-tenth of the energy which would normally be necessary to produce a latent image having the strong contrast now achieved by my method. The enhanced electrostatic image can then be developed in any appropriate manner known to the art and, if desired, readily transferred to a carrier sheet.

Figure 1:
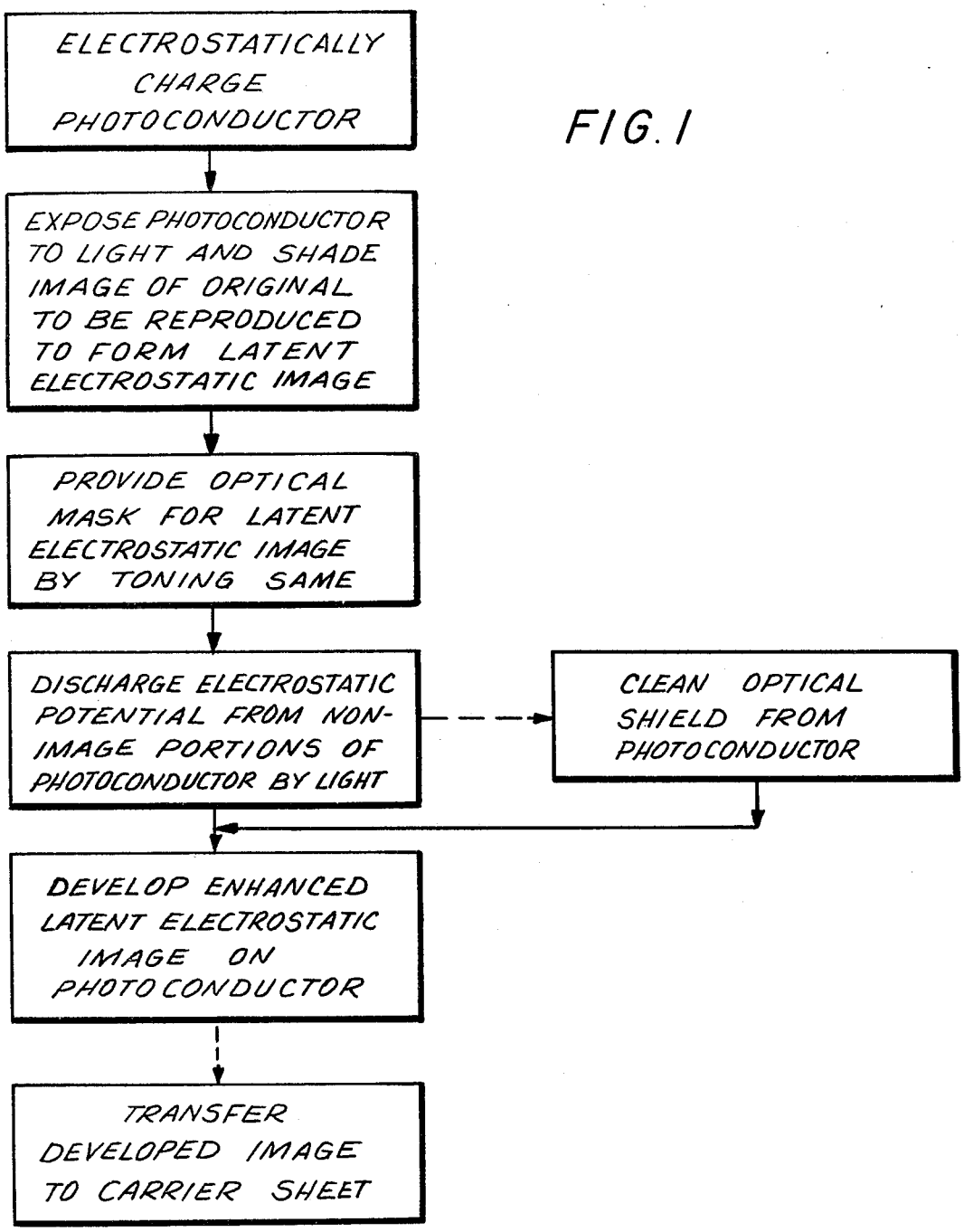
FIG. 1 is a flow diagram showing the steps of my improved method of electrophotography, in which the full-line arrows indicate necessary steps and the broken-line arrows indicate optional steps of my process.
Figure 2:
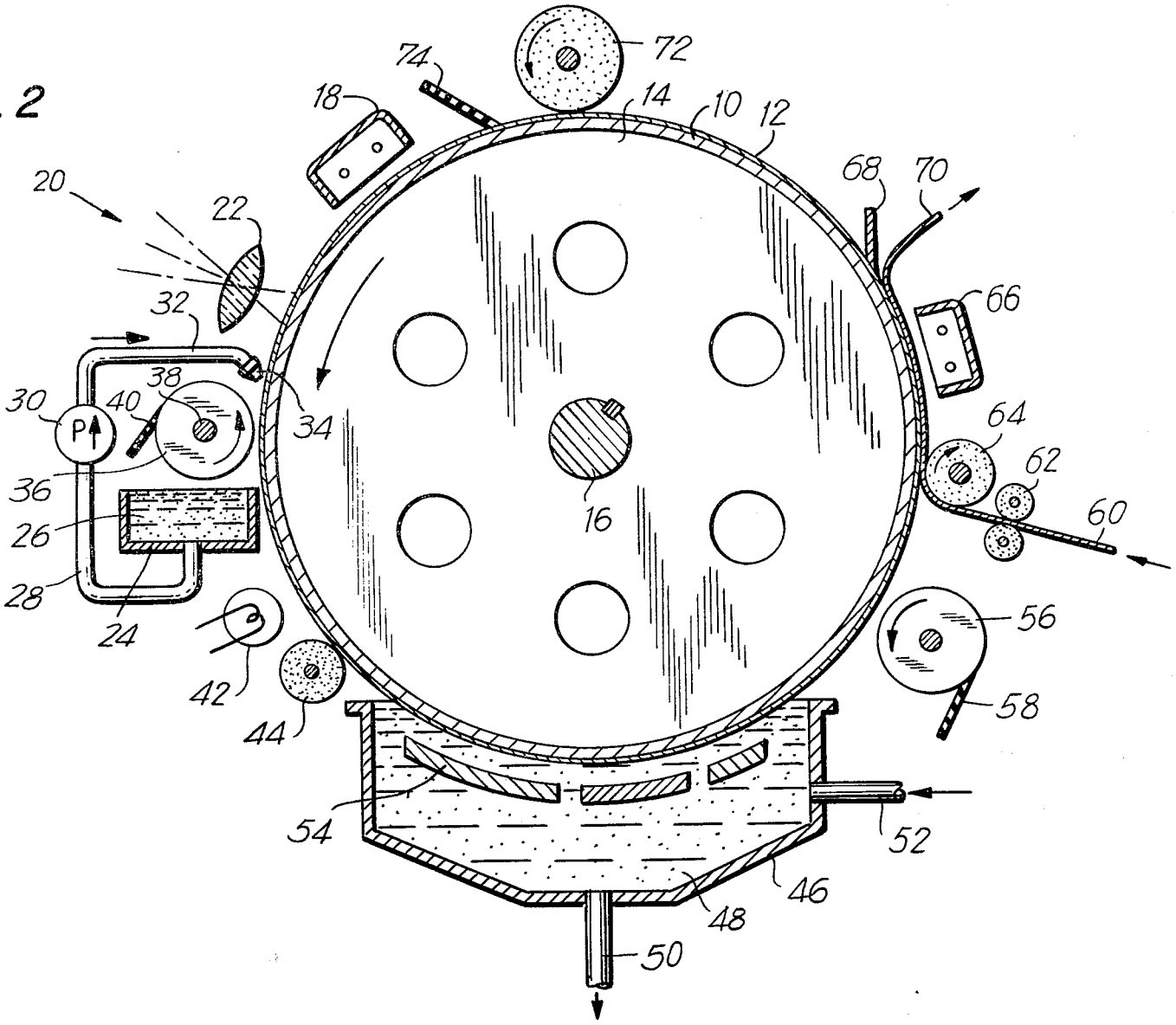
FIG. 2 is a diagrammatic view showing apparatus capable of carrying out my invention.

More particularly, referring now to FIG. 2 in which apparatus for carrying out my invention is shown, a metal drum 10 carries a photoconductive layer 12 which may be selenium. The metal drum 10 is supported by apertured disks 14 which are mounted on a shaft 16 and keyed thereto for rotation therewith. The shaft 16, which may be grounded, is driven by any appropriate means known to the art to rotate the drum 10 in the direction of the arrow. A charging corona 18 is adapted to charge the surface of the selenium photoconductor 12 to a voltage of between 800 and 1000 volts. To accomplish this, the charging corona is energized to a positive potential of 5000 or 6000 volts. The elements of the corona discharge unit cause ionization of the circum-ambient atmosphere and place a uniform positive charge over the surface of the selenium. If my process were being practiced with a zinc oxide-coated paper, the corona would be powered to produce a negative charge, as will be readily understood by those skilled in the art. The photoconductor 12 is then carried past the exposure station indicated generally by the reference numeral 20. Projection optics, indicated diagrammatically by the lens 22, project an image of the original to be copied upon the photoconductor 12. In my method, the exposure time is extremely short. I have made copies with an exposure of as little as 5% of normal and have been able to achieve completely satisfactory copies of the originals.

Figure 3:
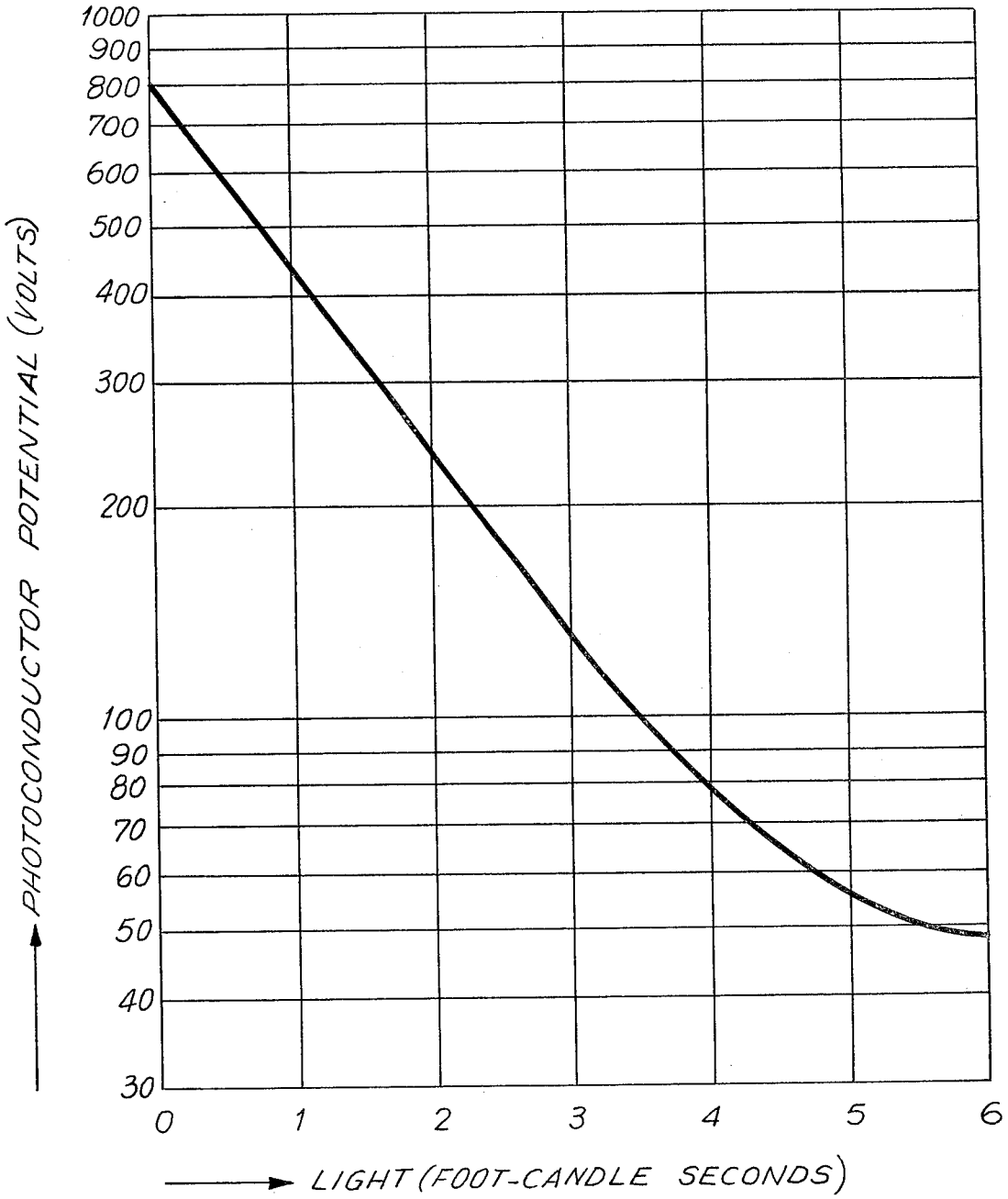
FIG. 3 is an idealized curve in which the ordinates are logarithmic and the abscissae are linear, showing the potential on the surface of the photoconductor plotted against quantum of light in foot-candle seconds to which the photoconductor has been exposed.
Figure 4:
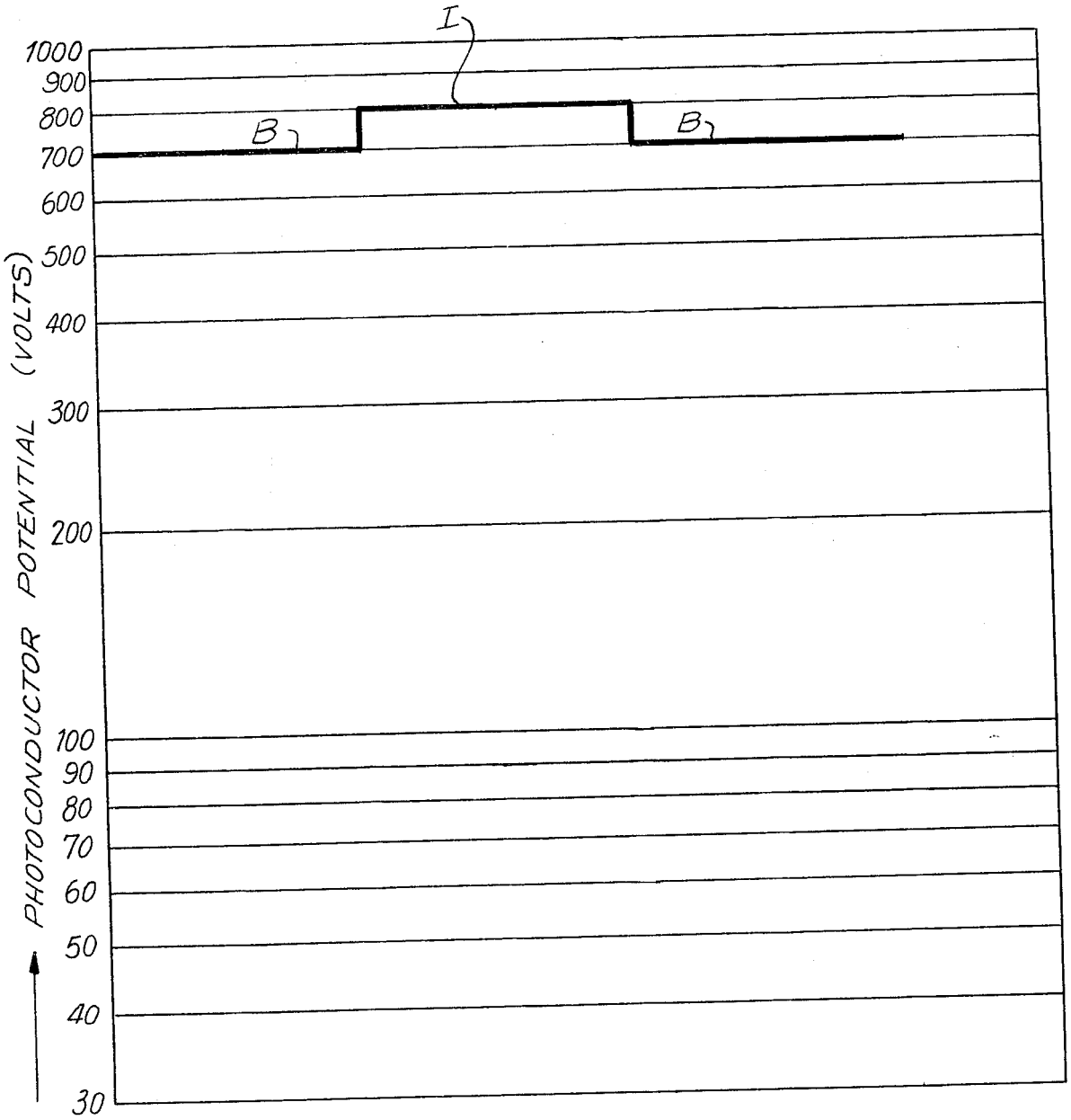
FIG. 4 is a chart plotted with logarithmic ordinates, showing the voltages on the surface of the photoconductor, charged as shown in FIG. 3, after an exposure of 0.25 foot-candle seconds.

A selenium photoconductor will generally discharge to about one-fifth of its original charge in about three foot-candle seconds. This can be readily seen by reference to FIG. 3, which shows a surface potential on a selenium photoconductor of 800 volts being discharged to 160 volts in between two to three foot-candle seconds. Normally, sufficient energy is employed in the light source of photocopying machines so that the background areas of the photoconductor will be discharged to about 50 or 60 volts. This will require about five foot-candle seconds. Five percent of this quantum of light is about 0.25 foot-candle seconds. By referring to FIGS. 3 and 4, it will be noted that, after this short exposure, the background areas (B) will have dropped in voltage about 100 volts from the image areas (I). If this image were toned, a very low-contrast image would be achieved. If this image, after being toned, were to be transferred onto paper from the drum, the density of the toned image would be so small that a poor transfer or a failure to transfer would result and only a faint image would appear. The low-contrast image, however, when developed, has sufficient optical density so that it provides a mask or shield for the latent electrostatic image which is sufficiently dense for the practice of my process.

Referring again to FIG. 2, I show apparatus for providing a mask or shield for the latent electrostatic image. It comprises a tank 24, from which a developing liquid 26 containing dispersed toner particles, which may be charged, is drawn through pipe 28 and pumped by pump 30 through pipe 32 to nozzle 34, adapted to discharge the developer between the photoconductor and a reverse roller 36. If the toner particles are conductive, they may acquire a charge by induction, owing to their passage adjacent the latent image under the action of its electric field. In this case, the electrostatic charge pattern serves first to charge the particles and then to trap them. In the case of a liquid-carried toner particle, the continuous phase is an insulating liquid—such as a hydrocarbon liquid, a fluorinated hydrocarbon liquid, or the like—having low vapor pressures at room temperature, and the disperse phase is composed of the minute particles of toner adapted to make the latent electrostatic image visible. As is known in the art, the polarity of the charged particles may be controlled by materials added to the developing liquid. These act by adsorption onto the surface of the particles and alter the magnitude and polarity of the charge acquired by the particles, depending on the environment of the particles at the time of their formation and the method of their preparation. The toner particles must be applied by a development electrode biased to a potential of the same polarity as that of the latent electrostatic image and to a potential greater than that of the background areas and below that of the image areas. Preferably, I employ a reverse roller as the development electrode when a liquid developer is used. This reverse roller is made of metal and is mounted on shaft 38 for rotation in a direction opposite to the rotation of the photoconductor. The reverse roller is insulated from ground and is positioned closely adjacent the surface of the photoconductor to provide a gap ranging from 0.05 to 0.1 millimeter. The reverse roller is driven by a prime mover and is controlled in speed so as to remove excess developing fluid from the photoconductor. The biasing of the development electrode is critical to my process, since there can be no masking of the background areas in my process, as will be pointed out more fully hereinafter. It will be appreciated that the close proximity of the insulated metal reverse roller to the surface of the charged photoconductor is such that it will float to assume the average potential of the photoconductor and thus be auto-biased. Since the average potential on the reverse applicator roller 36 will be above the background potential on the photoconductor, toner particles will migrate to the applicator roller instead of to the background areas on the photoconductor. If desired, instead of permitting the reverse applicator or metering roller 36 to float electrically, it may be biased to a potential from any appropriate D.C. voltage source to above the potential of the background areas but below the potential of the image areas. The bias on the toner applicator roller will substantially eliminate the deposition of masking toner on the background areas of the photoconductor. In the usual developing liquid, however, the carrier liquid has a low boiling point, so that it is easily vaporized to ensure that the developed image, when transferred to a carrier sheet such as paper, will produce a copy dry to the touch. In the masking step, however, a hydrocarbon carrier liquid having a higher boiling point which will not vaporize may be employed. This, of course, will reduce the danger of atmospheric pollution during the masking step. If desired, instead of a liquid-carried toner, dry toner may be used for the masking step. Such dry toners are well known to the art. One example of a reverse roller which can be used in my invention is shown in Hayashi et al U.S. Pat. No. 3,907,423. The excess toner from the masking step will be caught in the tank 24 for recycling. A wiper blade 40 keeps the metal reverse roller clean.

Figure 5:
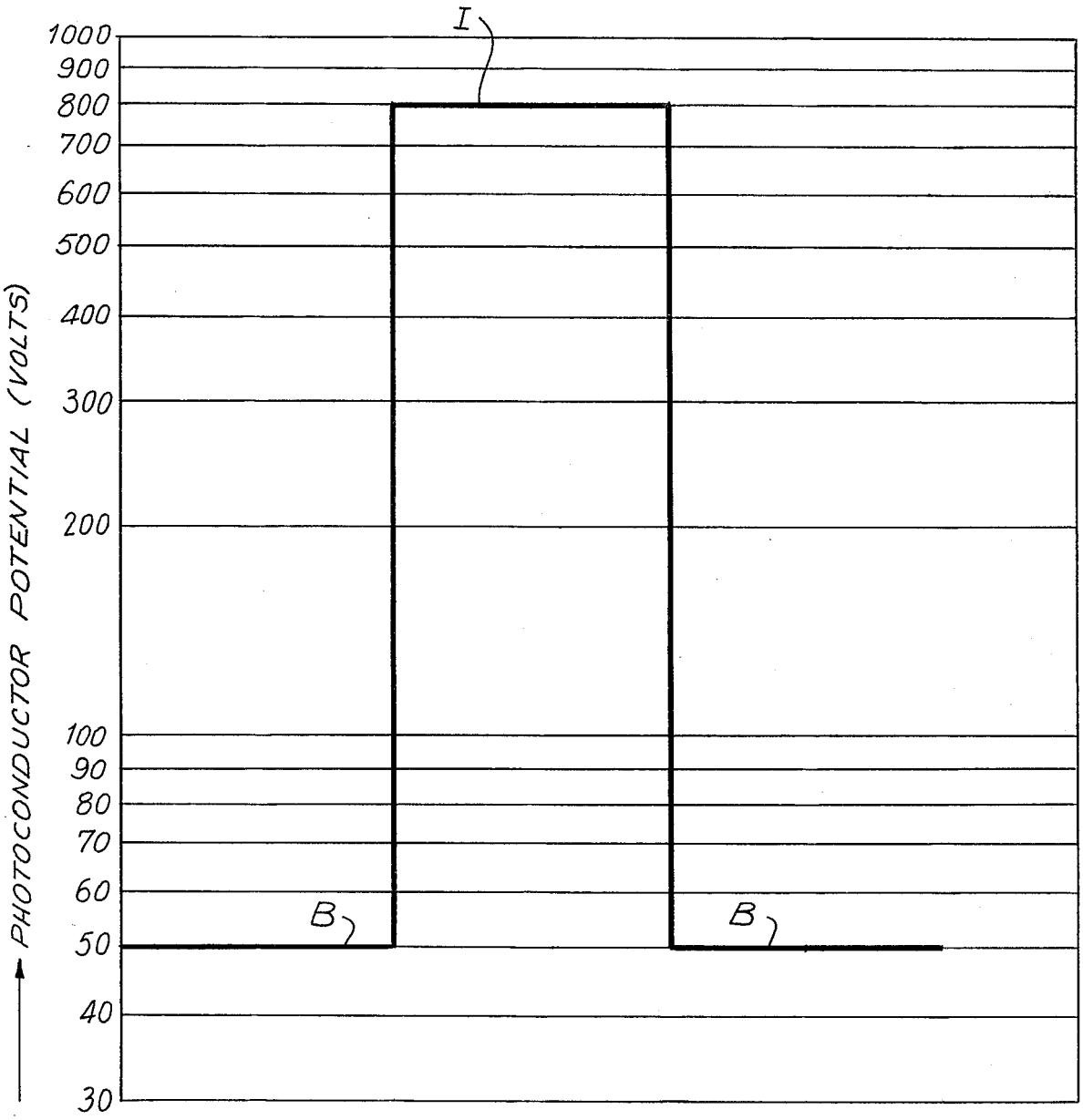
FIG. 5 is a view similar to FIG. 4, showing the voltages on the photoconductor after the image areas of FIG. 4 have been masked and the non-image or background areas have been discharged by light in accordance with my invention.

After the optical shield is produced in any appropriate manner such as described, the photoconductor is subjected to a blanket of light. This may be accomplished by an elongated incandescent lamp 42 placed adjacent the photoconductor bearing the masked image and extending thereacross. In an office copier, a quartz-halogen lamp having an output of about 500 watts is usually employed. In my process, a much lower-energy exposure lamp to project the image may be employed. Furthermore, the illumination of the background areas to discharge them to a residual voltage of about 50 volts requires comparatively small energy. As will be readily appreciated by those skilled in the art, the exposure step subjects the photoconductor to an image of the original by reflected light. The illuminated original is focused by the optical system upon the charged photoconductor. Since the light gathered by the optical system is a small fraction of the light which illuminates the original, a bright illumination of the original is required. In the background discharging step, after the optical shield is in place, the illumination of the photoconductor is by direct light, which accounts for the small energy required to discharge the background areas. The image areas (I) will not be discharged owing to the mask or shield which I have provided by my process as just described. The effect of discharging the potential of the background areas (B) while leaving the image areas (I) substantially undischarged is shown in FIG. 5.

It will be seen that my process has achieved a contrast of substantially 750 volts between the background areas and the image areas and accomplished the creation of this strong field at approximately a tenfold reduction of the energy required to expose the original. This means, as will be readily apparent, that a photocopying machine which presently uses a 500-watt lamp of the quartz-halogen type with a tungsten filament could use a 50-watt lamp or, alternatively, employ a fluorescent light. It will also be appreciated that, where a photocopying machine presently is able to make only about 25 copies per minute, theoretically, I can easily make a photocopying machine capable of producing 150 copies per minute. As a practical matter, however, owing to the inertia of the parts of the photocopying machine and in order to avoid marginal operation to provide a factor of safety, a photocopying machine which will produce 75 to 100 copies per minute can be made embodying my invention. Furthermore, this can be done without having to increase the energy expended significantly, since the only additional energy required will be that employed in the first developing or masking step and that in the light discharging of the photoconductor after the image areas have been masked. It will be further understood that, instead of an incandescent lamp, I may use any appropriate light source adapted to flood the photoconductor.

The use of a floodlight to enhance a faint latent image on a photoconductor is not new in and of itself. Steinhilper U.S. Pat. No. 2,756,676 describes a method of making a plurality of xerographic reproductions from a single exposure of an original. In Steinhilper, however, the effective speed of the photoconductor is not increased, owing to the fact that Steinhilper must go through a first development step which produces a fully-toned image. There is no masking step as described in my process. After the first image is developed, it is transferred to a carrier sheet such as paper. The faint image which is left on the photoconductor is of a potential too low to be enhanced by light or to be redeveloped. Steinhilper does not erase this image on the photoconductor, but recharges the photoconductor. He then discharges the background areas by light. Since the faint image does produce a shield, an enhanced latent image will be produced. The salient feature of my process, however, is absent from Steinhilper. He does not form a low-contrast latent electrostatic image in such a manner as to leave the background areas free of developer, owing to the fact that his development electrode is never biased but always at ground. Steinhilper must carry out his process to form the residual image from the first transfer of the developed image at the normal slow rate. Thus the unobvious result which I achieve—namely, the increasing of the effective sensitivity of the photoconductor—is not taught, nor can it be achieved, by Steinhilper.

Owing to the tremendous range through which I am enabled to obtain sufficient optical density to produce a mask, I can employ a single exposure and a biased setting in the developer system and obtain a sharp, clear copy from any original, whether the background is ultra white or dingy gray.

It will be readily apparent to those skilled in the art that, with the contrast potential shown in FIG. 5, there is no problem in obtaining a sharp, clear image. After the background potential has been discharged by the lamp 42, the optical shield may be wiped from the enhanced latent image thus formed by a cleaning roller 44 made of sponge rubber or the like, if desired. This wiping action can take place with either a liquid-toned mask or a dry developer-toned mask. The enhanced latent electrostatic image may then be toned by any usual method known to the art.

In FIG. 2, I have shown the toning system described in Schaefer et al U.S. Pat. No. 3,892,481, employing a tank 46 from which a liquid toner 48 circulates from pipe 50 to a toner supply tank (not shown) and back through pipe 52 to the tank 46. A development electrode 54 is controlled to bias any residual voltage left on the background of the photoconductor. It will be readily appreciated, however, that since I have discharged the background potential by my method, I can use a fixed bias slightly above the average residual bias of the background. This will produce a clear white background and enable me to eliminate, if desired, the sensing and biasing method shown in the Shaefer et al patent.

After development with a liquid-carried toner, a reverse roller 56, such as shown in Hayashi et al U.S. Pat. No. 3,907,423, is positioned to remove excess developer from the developed image. The reverse roller 56 is provided with a wiper 58. The reverse roller 56 is positioned and rotates at speeds as described in the Hayashi et al patent.

The image is now ready to be transferred to a carrier sheet such as plain paper. A plain paper sheet 60 is fed by rollers 62 to a roller 64, past a transfer-charging corona 66. It will be recalled that the toned image still comprises a visible image over a high positive charge on the surface of the selenium drum in the image areas which have not been discharged by light or by the bias applied to remove the residual background potential. To transfer the developed image from the drum to the paper carrier sheet, a high positive charge is applied to the back of the copy paper. As a result of the application of the high positive charge to the sheet, the toner particles are pulled from the drum surface onto the paper. A pick-off 68 ensures that the paper leaves the drum, and the end of the paper 70, now carrying the image, may be dried and passed to a receiving tray (not shown). A cleaning roller 72 wipes the drum clean of any particles of toner which have not been removed from the drum, and a wiper blade 74 completes the drum-cleaning operation.

It will be understood, of course, that if my process is applied to a zinc oxide-coated paper, the image will remain on the coated paper. It will also be understood that a dry toner, made of fusible resinous powder and fixed by heat, may be employed, as is well known to the art.

It will be understood by those skilled in the art that, since the photoconductor now bears an enhanced latent electrostatic image having a strong field, it may be developed in any appropriate manner known to the art.

A selenium photoconductor is very sensitive to blue light and, accordingly, photocopying machines using a selenium photoconductor do not produce copies from bluecolored originals with high contrast. That is to say, a selenium photoconductor "sees" blue light as almost white. My method will reproduce blue originals as if they were black. A yellow original is very light in color and reflects considerable light, so that it appears faint in the copies made by photocopying machines. My method of image-enhancing reproduces yellow effectively. Furthermore, gradations in density—that is, a gray scale—are also achieved with my method.

Owing to the wide latitude of effective photoconductive sensitivity which my process provides, when using the automatic bias of Schaefer et al U.S. Pat. No. 3,892,481, I can adjust the illumination in the step which forms the lowcontrast image prior to the mask-forming step to produce a satisfactory reproduction with the brightest background—that is, a pure white background—in the original document. This will produce an image of contrast too low to be effectively developed to a satisfactory copy, but such that the mask-forming step can be easily performed. The bias potential applied to the applicator roller will be well above that required to eliminate background potential of the latent electrostatic image completely, but will be below the potential of the image areas. This permits the image areas to be optically masked by toner during the optical shield-forming step. The illumination of the image-forming step may be readily controlled by varying the intensity of the light source or by a shutter in the optical path of the image-projection system.

It will be further understood by those skilled in the art that, while I have shown and described the toning of an image and then its transfer to a carrier sheet, my image-enhancing process can be used in any method of electrophotography. For example, the enhanced latent electrostatic image can be transferred to a dielectric sheet and then toned or developed into a visible image on the dielectric sheet, as is well known in the art.

It will be seen that I have accomplished the objects of my invention. I have increased the effective sensitivity of photoconductors. I have provided an improved method of electrophotography which will greatly increase the speed of copying operations. My method achieves this increase in speed with a reduction of the quantum of energy required. I am enabled to copy originals having poor contrast which will produce copies having surprisingly increased contrast as compared with the originals. I am enabled to copy originals formed in colors to which the photoconductor has great sensitivity and which, accordingly, do not ordinarily produce copies having the desired contrast. I have provided a novel apparatus for carrying out my improved method.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having this described my invention, what I claim is:

1. In a method of electrophotography in which a photoconductor is charged in the dark in a charging step, subjected to a light and shade image of a document to be copied to produce a latent electrostatic image of the document on the surface of the photoconductor in an exposing step, the latent electrostatic image is developed to provide a visible image on the photoconductor in a development step and said visible image is then transferred to a carrier sheet, the improvement comprising reducing the duration of the exposing step by a major portion of the time required to form a latent electrostatic image of satisfactory contrast to present a latent electrostatic image having a first contrast, toning said first-contrast electrostatic image with liquid-carried toner to provide an optical shield for the first-contrast latent electrostatic image while preventing deposition of toner on the background areas of the photoconductor, flooding the shielded first-contrast electrostatic image with light to discharge the unshielded areas of the photoconductor whereby to enhance the first-contrast electrostatic image to produce an electrostatic image having a contrast higher than said first contrast, removing the optical shield from the enhanced electrostatic image before practicing said developing step.

2. In a method of electrophotography in which a photoconductor is charged in the dark in a charging step, subjected to a light and shade image of a document to be copied to produce a latent electrostatic image of the document on the surface of the photoconductor in an exposing step, the latent electrostatic image is developed to provide a visible image on the photoconductor in a development step, the improvement comprising reducing the light energy of said exposing step by a major amount to form a latent electrostatic image having a low contrast, applying liquid-carried toner to said low-contrast electrostatic image to provide an optical mask for the low-contrast latent electrostatic image while preventing deposition of toner on the background areas of the photoconductor, subjecting the masked low-contrast electrostatic image on the photoconductor to the action of a low-intensity direct light to discharge the unmasked areas of the image whereby to enhance the low-contrast electrostatic image to produce an electrostatic image having a high contrast.

3. An improved method of electrophotography including the steps of charging a photoconductor, exposing the charged photoconductor by reflected light to a light and shade image of a document to be copied to form a less than normally exposed latent electrostatic image of the document on the surface of the photoconductor, applying liquid-carried toner to the latent electrostatic image by a biased toner applicator to form an optical mask over the image while leaving the background areas of the photoconductor free of toner, subjecting the photoconductor to direct light to discharge the non-image areas of the photoconductor to enhance the latent electrostatic image, removing the mask from the enhanced electrostatic image, developing the enhanced electrostatic image, and transferring the developed image to sheet material.

4. An improved method of electrophotography including the steps of charging the surface of a photoconductor, forming a relatively low-contrast latent electrostatic image of a document to be copied by projecting onto the surface of the photoconductor a light and shade image of the document having less illumination than required to produce an image of satisfactory contrast, masking the low-contrast latent electrostatic image with an optical mask by a first toning step performed with liquid-carried toner while preventing deposition of toner on the non-image areas on the photoconductor, immediately discharging the light areas of the image on the photoconductor by light to increase the electrostatic field differential between image areas and non-image areas, subjecting the resultant electrostatic image to a second toning step, and then transferring the toned visible image to sheet material.

5. A method of electrophotography including the steps of charging the surface of a photoconductor to a first potential, subjecting said surface to a light and shade image of a document to be copied to produce a latent electrostatic image having image areas and background areas of a potential appreciably greater than half the magnitude of said first potential, toning said image areas with liquid-carried toner to provide an optical mask therefor while preventing deposition of toner on the background areas, subjecting said surface to light to reduce said background area potential to a magnitude appreciably less than half the magnitude of said first potential, and developing said image areas.

* * * * *